United States Patent [19]

Shaub et al.

[11] Patent Number: 4,920,719

[45] Date of Patent: May 1, 1990

[54] METHOD AND APPARATUS OF POSITIONING A NEW CEILING OVER AN EXISTING CEILING

[75] Inventors: Melvin H. Shaub, Lancaster; J. Robert Herr, Millersville, both of Pa.

[73] Assignee: Armstrong World Industries, Inc., Lancaster, Pa.

[21] Appl. No.: 322,696

[22] Filed: Mar. 13, 1989

[51] Int. Cl.[5] ..... E04B 5/55

[52] U.S. Cl. ..... 52/488; 52/732; 52/664

[58] Field of Search ..... 52/481, 488, 664, 732, 52/738, 484, 488

[56] References Cited

U.S. PATENT DOCUMENTS

| | | | |
|---|---|---|---|
| 2,787,815 | 10/1956 | Brandstetter et al. | 52/664 |
| 3,839,839 | 10/1974 | Tillisch et al. | 52/738 |
| 4,769,965 | 9/1988 | Shaub | 52/488 |

*Primary Examiner*—James L. Ridgill, Jr.

[57] ABSTRACT

A runner system is provided to position a new ceiling over an existing ceiling and to position the new ceiling within a one to two inch space from the surface of the existing ceiling. Two z-shaped runners are fastened to the existing ceiling and ceiling boards will rest on the horizontal flanges of the z-shaped runners. A cross-runner is also designed to rest upon the horizontal flanges of the z-shaped runners and a projection and notch arrangement locks the cross-runners in position between the two adjacent z-shaped runners.

3 Claims, 2 Drawing Sheets

METHOD AND APPARATUS OF POSITIONING A NEW CEILING OVER AN EXISTING CEILING

BACKGROUND OF THE INVENTION

1. Field of the Invention

The invention is directed to a ceiling suspension system and, more particularly, to a ceiling suspension system that will position a new ceiling over an existing ceiling and with only an approximately one inch to two inches loss in ceiling height.

2. Description of the Prior Art

The fastening of runners to an existing ceiling is known in the art and cross-runners have been utilized therewith. The particularly inventive feature of the runner structure herein is the utilization of a locking means to position and hold the cross-runner in position relative to the main runner structure.

U.S. Pat. No. 4,769,965 is a ceiling system that is assembled similar to that system disclosed herein, but uses a different main runner system.

SUMMARY OF THE INVENTION

Two first or main runners are provided having a generally z cross-section. The upper flange of the main runners are nailed to an existing ceiling and the lower flanges form the support for a ceiling board. At least one cross-runner of a conventional inverted T-shape is utilized and the cross-runner rests upon the horizontal lower flanges of the main runner. There is a notch provided in the upper end of the vertical web of the cross-runner. There is provided a vertical web connecting the flange and lower flanges and the web has a step located at its midpoint with a projection so that the notch and projection will engage each other and hold the cross-runner in position between two main runners. The cross-runners are provided with an offset lip so that when the cross-runner lower flanges rest upon the lower flanges of the main runners, the bottom portion of the runners of both the main runner and the cross-runner are in the same plane.

The ceiling structure above permits the use of a method for positioning the cross runner in position between two main runners. A space is formed between the existing ceiling and the lower horizontal flanges of the main runners and this space is approximately one to two inches in size. The cross-runners are longer in length than the spacing between the ends of the flanges of two adjacent main runners. One end of a cross-runner is inserted into the space between the step of the vertical web of one main runner and the existing ceiling. This permits the other end of the cross-runner to move above the plane of the lower flange of the adjacent main runner. The cross-runner is now moved laterally so that the ends of the cross-runner may rest upon the horizontal flanges of the main runners. A notch and groove locking arrangement locks the cross-runner in position so that it may not be accidentally moved laterally whereby one end of the cross-runner will drop away from the flange of the main runner.

DESCRIPTION OF THE PREFERRED EMBODIMENT

Figure 2:
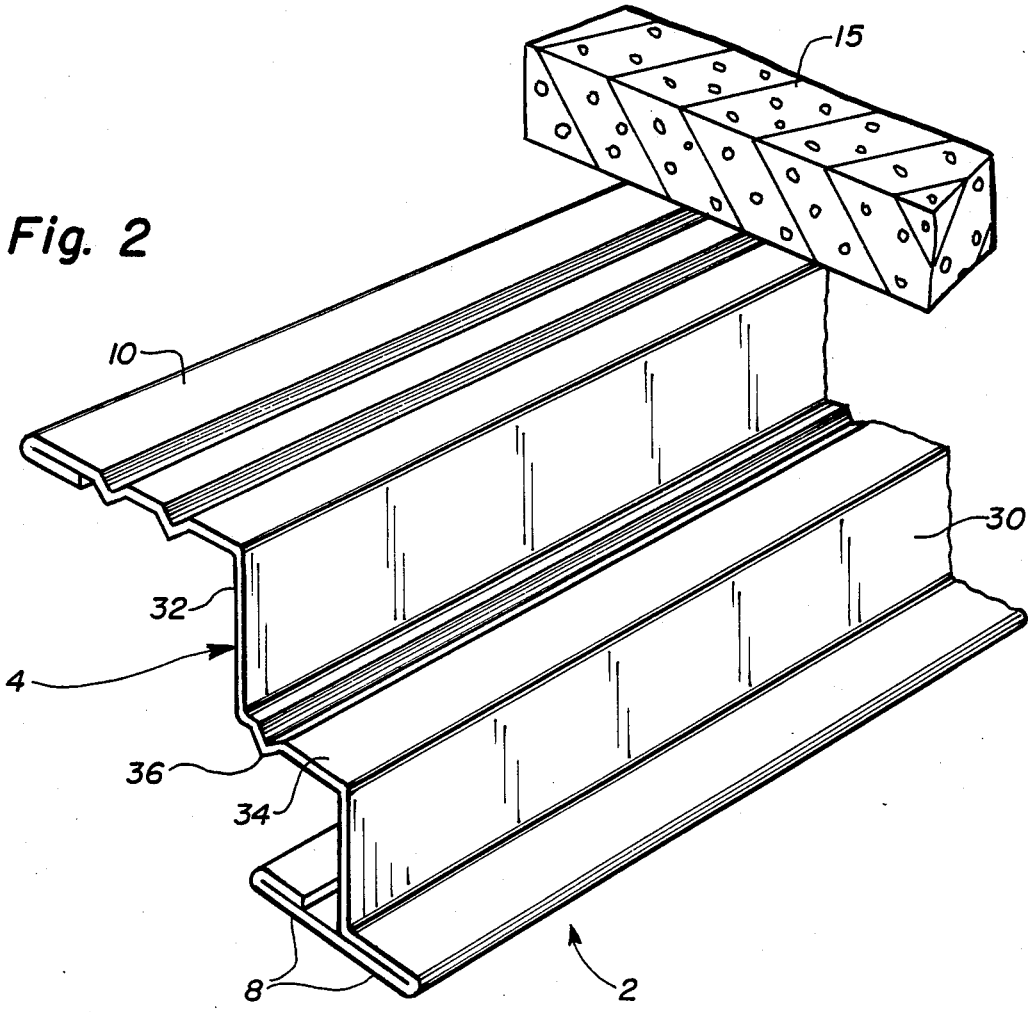
FIG. 2 is a perspective view of a main runner.
Figure 3:
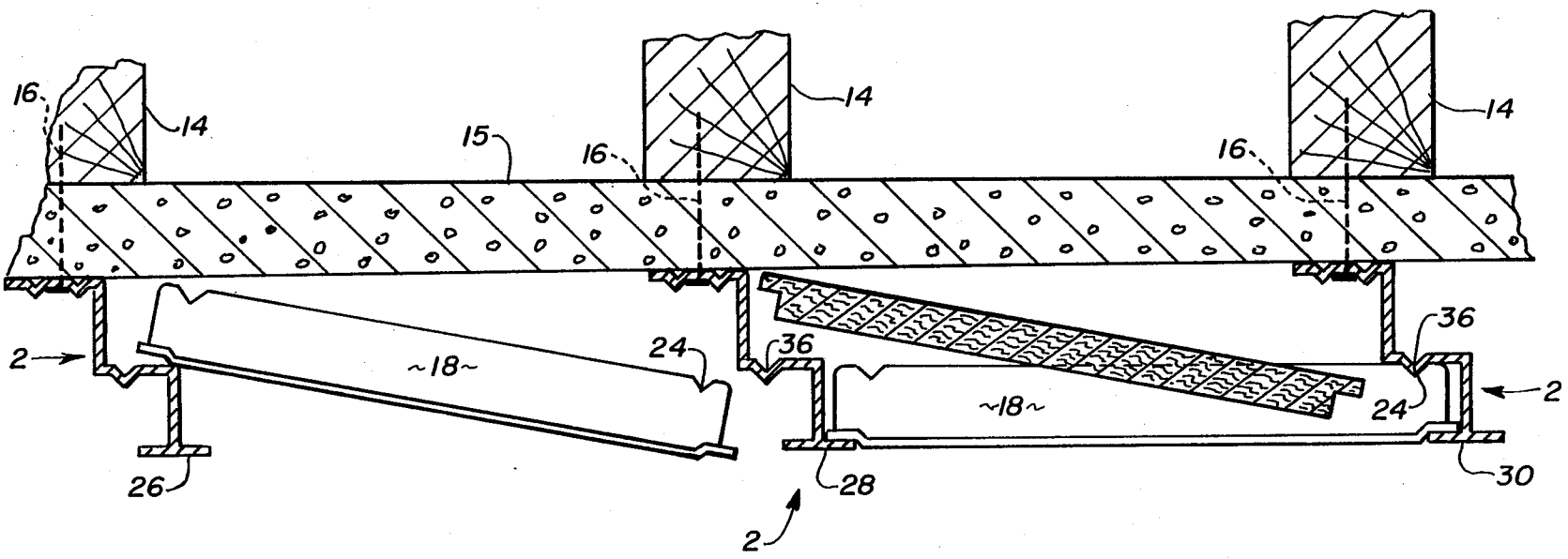
FIG. 3 is a cross-section of an existing ceiling showing the cross-runner and ceiling board being positioned between two adjacent main runners.

The ceiling system of the drawings comprises at least two first runners 2 (FIG. 2). Each first runner has a generally z cross-section, a vertical web 4, and, at the lower end of the vertical web, equal width horizontal lower flanges 8. The flanges extend either side of the vertical web perpendicular to the web. At the top of the vertical web 4 there is a single long upper horizontal flange 10 extending from one side of the vertical web perpendicular to the web. The single horizontal flange 10 is of a width greater than the width of a lower flange as measured from the vertical web 4 to the end of one portion of the horizontal flange extending to one side of the vertical web. This size difference can clearly be seen in FIG. 2. The first runners or main runners 2 are adapted to be fastened by nails 16 to the face of the an existing ceiling. As seen in FIG. 3, the existing ceiling would be primarily rafters 14 covered with some type of covering 15 which could be drywall or some other like material. The means 16 fastens the upper flange of the runner 2 to the existing ceiling with the lower flange 8 of the first runner or main runner spaced approximately one to two inches from the surface of the existing ceiling and parallel to the face of the existing ceiling.

Figure 1:
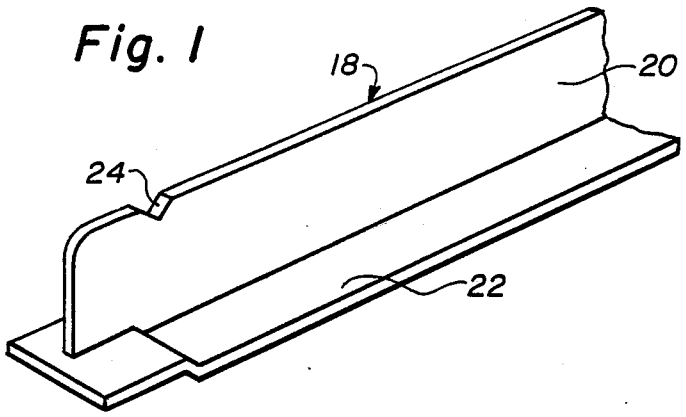
FIG. 1 is a perspective view of a cross-runner.

There is provided at least one cross-runner 18 which has an inverted T-shape (see FIG. 1). The cross-runner has a vertical web 20 with an upper and lower end. At the lower end of the vertical web, there is equal width horizontal flanges 22 extending either side of the vertical web parallel to the web. At the upper end of the vertical web, near each end thereof, there is positioned a notch 24.

FIG. 3 shows the method of positioning a new ceiling over an existing ceiling. On the left side of FIG. 3, there is shown a cross-runner and on the right side of FIG. 3, there is shown a ceiling board. Both are mounted in position in the same manner. The overall length of the cross-runner or ceiling board is greater than the distance between the edge of the right lower flange of runner 26 and the edge of the left lower flange of runner 28. A space 38 exists adjacent flange 26 and the existing ceiling and this space is approximately one inch.One end of a cross-runner or a ceiling board is inserted into this space. This provides sufficient clearance for the other end of the cross-runner or ceiling board to clear the edge of the horizontal flange of the adjacent main runner 28. Once the edge of the lower flange of runner 28 is cleared, the cross-runner or ceiling board can be moved laterally left to right and the cross-runner or ceiling board is positioned on the horizontal lower flanges 8 of the main runner.

The vertical web 4 has the unique structure shown in FIG. 2. The web has a lower member 30 perpendicular to the horizontal lower flanges 8 and an upper member 32 perpendicular to the horizontal upper flange 10. The two members 30 and 32 are parallel to, but spaced from each other. The upper end of member 30 and the lower end of member 32 are interconnected by member 34. Projecting from the underside of member 34, and towards the horizontal lower flange on the left side of the vertical web, is a projection 36.

As seen in FIG. 3, right side, a cross-runner 18 is positioned between two adjacent main runners 28 and 30. One end of the cross-runner rests on the lower flange of runner 28 and the other end of the cross-runner rests on the lower flange of runner 30. The notch 24 on the right side of the cross-runner 18 engages the projection 36 at about the midpoint of the vertical web 4 whereby the projection and notch engagement holds the cross-runner in position between the two adjacent main runners.

The area formed between the covering 15, upper member 32 of the vertical web and member 34 of runner 26 forms a recessed area 38 into which is inserted one end of the cross-runner or ceiling board so there is sufficient clearance for the other end of the cross-runner or ceiling board to clear the horizontal flange of the adjacent runner 28.

The invention herein is an improvement over that of U.S. Pat. No. 4,769,965 and that patent is incorporated herein by reference.

What is claimed is:

1. A ceiling system comprising:

(a) at least two first runners each having a generally z cross-section, the first runner having a vertical web, at the lower end of the vertical web there being lower horizontal flanges extending either side of the vertical web perpendicular to the web, at the top of the vertical web there being a single long upper horizontal flange extending from one side of the vertical web perpendicular to the web and beyond the lower flanges, said first runners being adapted to be fastened to the face of an existing ceiling by a means fastening the upper flange to the ceiling with the lower flanges spaced from and parallel to the face of the existing ceiling, (b) at least one cross-runner having an inverted T-shape, the cross-runner having a vertical web with an upper and lower end, and, at the lower end of the vertical web, there being horizontal flanges extending either side of the vertical web perpendicular to the web, at the upper end of the vertical web near at least one end thereof there being positioned a notch;

(c) said cross-runner being positioned between two adjacent first runners with one end of the cross-runner resting on the lower flange of one first runner and the other end of the cross runner resting on the lower flange of the adjacent second first runner, the notch on at least one end of the cross runner engaging the below defined projection on the two adjacent runners whereby the projection and notch engagement holds the cross runner in position between two adjacent runners; and (d) the improvement comprising:

(i) said vertical web being formed of a lower member perpendicular to the lower flanges, an upper member perpendicular to the upper flange, said two members being parallel to, but spaced from each other, another member interconnecting said two parallel members and having a projection thereon extending therefrom in the direction of the lower flanges.

2. A ceiling system as set forth in claim 1 wherein:

(a) said lower horizontal flanges of said cross-runner and first runners are of equal width and support the edges of a ceiling board.

3. A ceiling system as set forth in claim 1 wherein:

(a) said cross-runner, on each end thereof, has the ends of the cross-runner resting on the lower flange of the first runners, and (b) said each end of the cross-runner being formed with an offset lip whereby the lip rests on the top of the horizontal flange of the first runner and the bottom of the first runner flange and bottom of the cross runner flange are in the same plane.

* * * * *